US005332272A

United States Patent [19]

Prince

[11] Patent Number: 5,332,272

[45] Date of Patent: Jul. 26, 1994

[54] HOISTING SLING

[76] Inventor: Dorris W. Prince, 14811 Sylvia Dr., Brookpark, Ohio 44142

[21] Appl. No.: 75,415

[22] Filed: Jun. 14, 1993

Related U.S. Application Data

[63] Continuation-in-part of Ser. No. 969,587, Oct. 30, 1992, abandoned.

[51] Int. Cl.[5] ..... B66C 1/66

[52] U.S. Cl. ..... 294/97; 294/82.11

[58] Field of Search ..... 294/74, 75, 82.11, 89, 294/97

[56] References Cited

U.S. PATENT DOCUMENTS

| | | | |
|---|---|---|---|
| 106,964 | 11/1870 | McClellan . | |
| 1,744,854 | 4/1930 | Weed . | |
| 1,890,734 | 12/1932 | Kuberka | 294/97 X |
| 1,918,007 | 7/1933 | Woodruff . | |
| 2,315,146 | 2/1943 | White | 294/65.5 |
| 2,356,146 | 8/1944 | Caldwell | 294/1 |
| 2,541,449 | 2/1951 | Vickers | 229/45 |
| 2,584,124 | 2/1952 | Gustafson | 294/97 |
| 2,818,296 | 12/1957 | Brennan et al. | 294/67 |
| 2,947,994 | 3/1961 | Goldsmith | 294/74 |
| 3,132,890 | 5/1964 | Beaudet | 294/97 X |
| 3,284,125 | 11/1966 | Blaske, Sr. et al. | 294/97 X |
| 3,307,871 | 3/1967 | Russell et al. | 294/97 X |
| 3,332,118 | 7/1967 | Temple et al. | 24/123 |
| 3,385,627 | 5/1968 | Zumbo | 294/97 X |
| 3,390,864 | 7/1968 | Searcy et al. | 294/97 X |
| 4,838,595 | 6/1989 | Spillar | 294/97 X |

FOREIGN PATENT DOCUMENTS

| | | | |
|---|---|---|---|
| 698899 | 12/1979 | U.S.S.R. | 294/97 |
| 2119748 | 11/1983 | United Kingdom | 294/97 |

*Primary Examiner*—Dean J. Kramer
*Attorney, Agent, or Firm*—Albert E. Chrow

[57] ABSTRACT

A hoisting sling is provided that in one embodiment (100) features a pivot assembly (4) secured to at least one end of a flexible elongate lifting element such as a cable, rope or chain. A cross bar (6) is pivotally mounted in assembly (4) and is operative to pivot to a position enabling assembly (4) to be inserted through an opening in an object to be hoisted and thence pivot so as to bridge across the opening to enable the lifting element to hoist the object. In another embodiment (150), the pivot assembly (14) features a two-piece cross bar (18 and 18') that are operative to pivot towards each other to a position enabling assembly (14) to be inserted through the object opening and thence pivot away from each other to bridge across the opening.

8 Claims, 3 Drawing Sheets

HOISTING SLING

This application is a continuation-in-part, of application Ser. No. 969,587, filed Oct. 30, 1992 now abandoned.

This invention relates generally to a hoisting sling for use in lifting objects and more particularly to a hoisting sling comprising at least one flexible elongate lifting element such as rope, cable or chain having a pivot assembly secured to at least one end that includes a cross bar pivotally mounted to the pivot assembly at a location substantially equidistant from its opposite ends and operative to pivot to a position effective to enable the cross bar to be inserted through an opening through the object and thence pivot to a position operative to enable the cross bar to bridge across the opening to enable the lifting element to hoist the object.

BACKGROUND OF THE INVENTION

Hoisting slings have been known for many years and are useful in providing a connecting link between a chain hoist, winch or crane and an object to be hoisted or lifted.

Such slings characteristically feature an elongate flexible lifting element such as a rope, cable, strap or chain having a hook secured to one or both of its ends for hooking onto an object to be hoisted.

In some instances, such slings feature a hook secured to one end and an eyelet secured to the opposite end that can be engaged by a hook attached to the winch or crane being used to hoist the object.

In other instances, such slings have featured a plate or bracket at one end that enables the end of the lifting element to be secured by bolts or the like to the object to be hoisted.

Early examples of a sling hoist having lifting elements having a hook at one end and an eyelet at the other end are disclosed in U.S. Pat. Nos. 1,755,854; 1,918,007; 2,356,146; and 2,541,449, the disclosures of which are incorporated hereby by reference.

Examples of sling hoists whose lifting elements are adapted to be secured to the object to be lifted by a bolt or the like is disclosed in U.S. Pat. No. 2,315,146, the disclosure of which is incorporated herein by reference.

Examples of hooks operative to be used in sling hoists are disclosed in U.S. Pat. Nos. 200,510 and 264,530, the disclosures of which are incorporated herein by reference.

In two instances since the late eighteen hundreds, a pivotal cross bar has been employed for insertion through an opening through an object and thence pivoting to bridge across the hole to prevent the removal thereof. In neither instance is disclosed or suggested that the pivoting principle might be adapted for use in connection with sling hoists. In the first instance, a wagon bolt employed a guard (d) pivotally mounted on the end of a rigid shaft (a) is disclosed in U.S. Pat. No. 109,640, the disclosure of which is incorporated herein by reference. Here, the pivotal shaft is not secured to the end of an elongate flexible lifting element such as rope, cable, strap or chain but rather to a wooden shaft and no suggestion is made that such concept might be adaptable to sling hoists.

In the second instance, a safety line id disclosed in U.S. Pat. No. 3,332,118, the disclosure of which is incorporated herein by reference. Here, however, the pivotal member requires a two cable connection to the cross bar (3) that itself is pivotally mounted at one end and may not proximate the center as is the case for the present invention.

In contrast to the prior art hereinbefore described, the hoisting sling of the present invention in one embodiment employs a pivot assembly that is economical to manufacture and simple in design by featuring a cross bar that is pivotally mounted proximate the center and can be easily inserted through an opening through an object and then pivoted to a position causing the cross bar to bridge across the opening to enable the lifting element to commence the task of hoisting the object.

In yet another embodiment of the invention, the pivot assembly cross bar is a two-piece cross bar with each piece having one end pivotally mounted to the pivot assembly and which may further include at least one biasing member operative to bias the pieces away from each other in the manner of a toggle bolt or the like.

In still another embodiment a locking pin is included to prevent the cross bar from being inadvertently withdrawn from the opening through the object.

SUMMARY OF THE INVENTION

Accordingly, it is an object of this invention to provide a hoisting sling having at least one flexible elongate lifting element such as rope, cable or chain to at least one end of which is secured a pivot assembly having a cross bar that is easily inserted through an opening in an object to be lifted and then easily pivoted to a position operative to cause the cross bar to bridge across the opening to enable the lifting element to hoist the object.

It is another object of this invention to provide a hoisting sling having at least one flexible elongate element to at least one end of which is secured to a pivot assembly having a two-piece cross bar operative to be inserted through an opening in an object to be lifted and thence respectively pivot away from each other to a position effective to cause the combination thereof to bridge across the opening to enable the lifting element to hoist the object.

DESCRIPTION OF PREFERRED EMBODIMENTS

Figure 1:
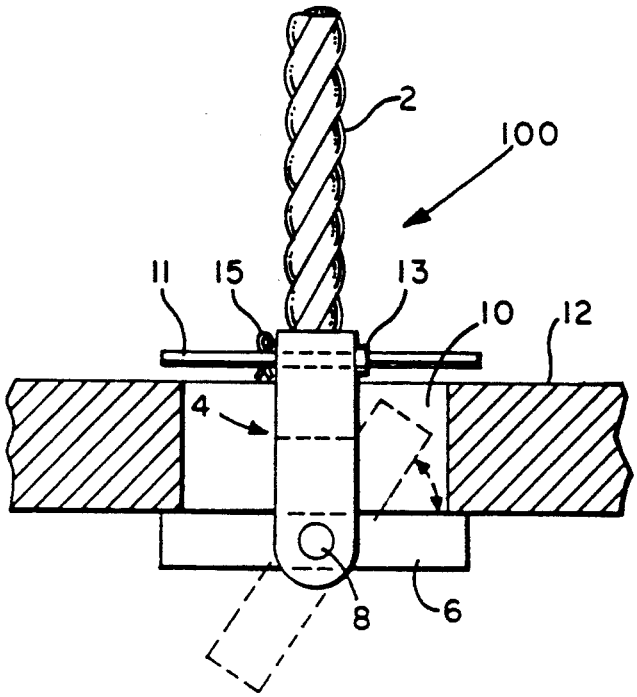
FIG. 1 is a partial cross sectional side elevated view of an embodiment of the hoisting sling of the invention.

Hoisting sling 100 of FIG. 1 has a flexible elongate lifting element in the form of cable 2 to the end of which is secured a pivot assembly 4. Pivot assembly 4 has a cross bar 6 pivotally mounted thereon by means of a pivot shaft referenced by numeral 8 located substantially equidistant from the opposite ends of cross bar 6.

Hoisting sling 100 is being used to hoist an object 12 having an opening 10 therethrough. Cross bar 6 is operable to pivot to the dashed position shown in FIG. 1 such that pivot assembly 4 can be inserted through opening 10 and thence pivot to a position enabling cross bar 6 to bridge across opening 10 to enable cable 2 to hoist object 12. Understandably, the length of cross bar 6 must be broader than the breadth or diameter of opening 10 in order for it to engage the underside of object 12 on opposite sides of opening 10.

Also shown in FIG. 1 is a locking means such as a pin or clip referenced by numeral 11 that, although may have any configuration, is shown for illustrative purposes in FIG. 1 as a pin having an enlarged shoulder 13 that abutts against assembly 4 when pin 11 is inserted therethrough after cross bar 6 has been inserted through opening 10. A cotter pin 15 is then inserted through a transverse opening through pin 11 adjacent the opposite side of an opening through assembly 4 through which pin 11 is inserted.

The length of pin 11 is predetermined to exceed the breadth of opening 10 by an amount suitable to enable pin 11 to prevent cross bar 6 from pivoting sufficiently to be inadvertently withdrawn through opening 10.

The pivot assembly of the invention is made from one or more materials suitable for the particular hoisting activity involved. Most commonly the assembly is made from suitable high strength steel alloys. As previously described, the pivot assembly of the invention may be secured to one or both ends of a lifting element such as a rope, cable, chain or strap. Preferably, the lifting element is a strap made from a flexible material having suitable strength such as nylon.

Figure 2:
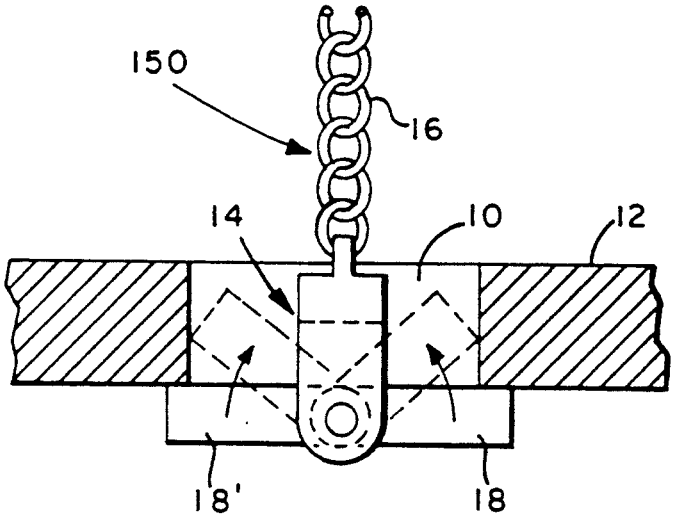
FIG. 2 is a partial cross sectional side elevation view of another embodiment of the hoisting sling of the invention.

The lifting element of hoisting sling 150 of FIG. 2 is an elongate flexible chain 16 to the end of which is secured a pivot assembly referenced by numeral 14. The cross bar for pivot assembly 150 differs from cross bar 6 of FIG. 1 by being a two-piece cross bar referenced by numerals 18 and 18' that respectively have one end pivotally mounted on pivot assembly 14 and are operative to pivot towards each other as shown by the dashed line position in FIG. 2 to a position enabling pivot assembly 14 to be inserted through opening 10 and thence pivot away from each other that the combination of cross bar pieces 18 and 18' are operative to bridge across opening 10 enabling sling 150 to hoist object 12.

Figure 3:
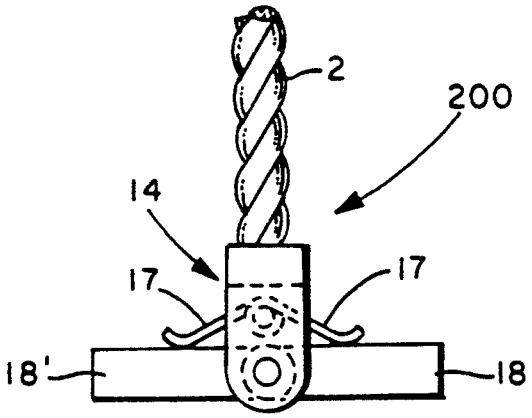
FIG. 3 is a partial side elevation view of the hoisting sling embodiment of FIG. 2 further including a biasing member.

The embodiment of hoisting sling 200 of FIG. 3 is the same as sling 150 of FIG. 2 except that chain 16 is now a rope and pivot assembly 14 further includes a biasing member such as spring 17 that is operative to urge cross bar pieces 18 and 18' away from each other as they emerge on the opposite side of the opening into which pivot assembly 14 has been inserted much in the manner of a toggle bolt.

Figure 4:
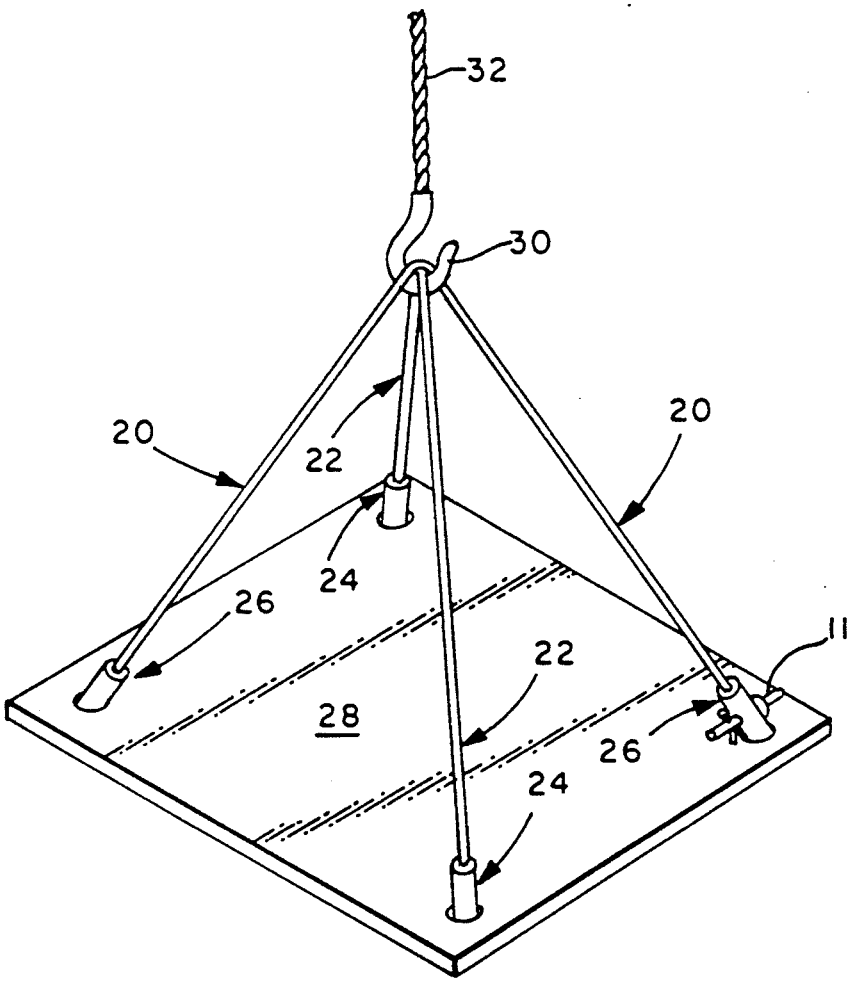
FIG. 4 is a perspective view of two hoisting slings of the invention being used to hoist a platform.

FIG. 4 illustrates but one of the numerous ways that the hoisting sling of the invention can be used to hoist an object. In FIG. 4, a pair of hoisting slings of the invention referenced by numerals 20 and 22 respectively are being used to hoist platform 28. Sling 20 has a pivot assembly 26 and sling 22 has a pivot assembly 24 secured to each end. Pivot assemblies 24 and 26 extend through openings through platform 28 that are not referenced and both slings 20 and 22 are being lifted by a hook 30 that is secured to a rope 32 that in turn is connected to a winch or crane. Each of pivot assemblies 24 and 26 include respective cross bars that have pivoted to bridge across the openings through platform 28 in the manner hereinbefore described.

Also shown in FIG. 4 is locking pin 11 previously described with respect to FIG. 1. Such locking means is operative to prevent the pivotal cross bar of pivot assembly 26 from pivoting sufficiently to be inadvertently withdrawn from the opening through the object after having been received therethrough and pivoted to bridge across opening 10. Although not shown in FIG. 4, all of pivot assemblies 24 and 26 preferably include locking means such as pin 11. The hoisting sling of the invention may feature a pivot assembly secured to one end and an eyelet secured to the opposite end as previously described and their use may be in conjunction with other lifting apparatus used in the art such as spreader bars and the like.

Figure 5:
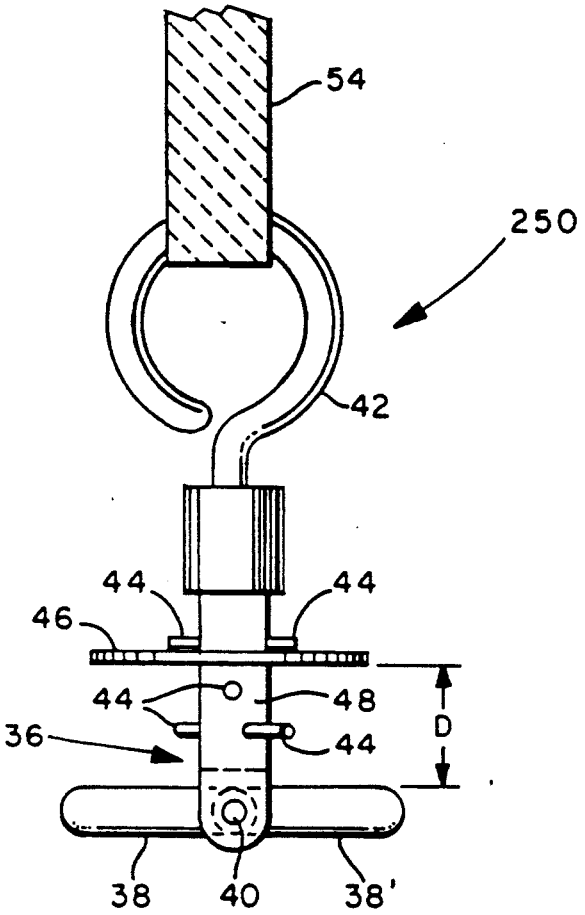
FIG. 5 is a partial side elevation view of a preferred embodiment of the hoisting sling of the invention.

FIG. 5 illustrates a particularly preferred embodiment of the hoisting sling of the invention referenced by numeral 250. Hoisting sling 250 has a pivot assembly referenced by numeral 36 that includes either a singular pivotable cross bar or pair of opposed pivotable cross bars such as referenced by numerals 38 and 38' at one end that are pivotable about pivot point 40 and are operative to pivot from a closed position to an open position parallel to the plane of an opening in an object to be lifted after having been inserted through the opening as previously described.

The opposite end of pivot assembly 36 is secured to a flexible lifting element in the form of a strap referenced by numeral 54 by means of an intermediate open loop 42 that is secured to both pivot assembly 36 and strap 54.

Figure 6:
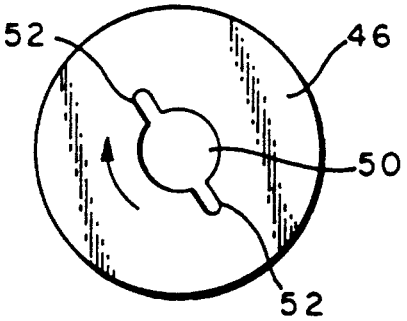
FIG. 6, is a plan view of a locking washer 46 used in connection with the hoisting sling of FIG. 5.

Pivot assembly 36 of hoisting sling 250 includes locking means in the form of a plate or washer 46 shown in FIGS. 5 and 6 whose breadth is greater than the breadth of the opening in the object to be lifted through which cross bars 38, 38' are inserted and that includes at least one and preferably at least a pair of slots 52 that are preferably diametrically opposed to each other and respectively extend outwardly from the inner periphery surrounding opening 50 through which the stationary member 48 of pivot assembly 36 of FIG. 5 is received.

Member 48 of pivot assembly 36 includes at least one and preferably a plurality of spaced protuberances or pins 44 such as shown in FIG. 5 that are spaced axially along stationary member 48 at different rotational angles from a theoretical reference point. Even more preferably, pins 44 comprise opposed pins at each axial location along member 48 that are oriented at 90° to the direction of the pins at adjacent axial locations along member 48.

Pins 44 at each axial location are preferably receivable through the opening through the object through which cross bars 38 and 38' are received as well as being receivable through corresponding slots 52 in plate or washer 46 of FIG. 5 upon registration therewith.

In operation, locking plate or washer 46 is assembled upon pivot assembly 36 and operative to move axially in opposite directions along member 48 upon registering slots 52 with pins 44 and then moving plate or washer 46 axially thereby and then rotating locking plate or washer 46 as shown by the arrow in FIG. 6 to either register with the next pin location for further axial movement or to provide an axial direction "D" between plate or washer 46 and open cross bar 38, 38' shown in FIG. 5 that is larger by a predetermined amount than the thickness surrounding the opening through the object to be lifted since, once positioned axially with the one or more slots in plate or washer 46 not in registration with the one or more pins adjacent the side of plate or washer member 46 facing away from the object, plate or washer 46, washer 46 is prevented thereby from moving axially away from the object to provide an effective means for locking assembly 36 to the object to be lifted.

Rotation can then be employed to position slots 52 in registration with pins 44 to relocate locking plate or washer 46 by moving it axially along member 48 in a direction away from cross bars 38 and 38' to enable them to be pivotally contracted together for removal from the object opening.

The hoisting sling of the invention is convenient to use and highly effective for hoisting objects such as, for example, an air conditioning unit to the top of a building.

What is claimed is:

1. A hoisting sling comprising at least one elongate flexible lifting element secured to an end of a stationary member of a pivot assembly having at least one cross bar pivotally mounted thereto;

said cross bar operative to pivot to a position effective to enable the cross bar to be inserted through an opening through an object to be hoisted and thence pivot to a position enabling the cross bar to bridge thereacross to enable the lifting element to hoist the object;

said stationary member having a plurality of protuberances extending therefrom in respective axial spaced-apart relationship to each other and to the cross bar;

a locking plate axially movable along the stationary member and having at least one slot extending outwardly from an inner periphery surrounding an opening therewith through which the stationary member is received;

said protuberances respectively operative to prevent the locking plate from moving axially away from the object when not in registration with the slot; and said protuberances respectively operative to be received through the slot upon registration therewith to enable the locking plate to be moved axially away from the object so as to enable the cross bar to be pivoted for removal from the object opening.

2. The hoisting sling of claim 1, wherein the lifting element has one of the pivot assemblies secured at each of the opposite ends thereof.

3. The hoisting sling of claim 1 wherein the lifting element is a selected one of rope, cable, and strap.

4. The hoisting sling of claim 1 wherein the strap is a nylon strap.

5. The hoisting sling of claim 1 wherein the pivot assembly cross bar is a two-piece cross bar with each piece having one end pivotally mounted on the pivot assembly such that they pivot towards each other to a position enabling both pieces to be inserted through the object opening and thence pivot away from each other to a position such that the combination thereof is operative to bridge across the opening to enable the lifting element to hoist the object.

6. The hoisting sling of claim 5 wherein the pivot assembly further includes at least one biasing member operative to urge the cross bar pieces away from each other.

7. The hoisting sling of claim 1 wherein the stationary member includes a plurality of the protuberances at at least one axial location and the locking plate includes a plurality of the slots respectively registerable therewith.

8. A hoisting sling comprising at least one elongate flexible lifting element secured to an end of a stationary member of a pivot assembly having at least one cross bar pivotally mounted thereto;

said cross bar operative to pivot to a position effective to enable the cross bar to be inserted through an opening through an object to be hoisted and thence pivot to a position enabling the cross bar to bridge thereacross to enable the lifting element to hoist the object;

said stationary member having a plurality of protuberances extending therefrom at a location in axial spaced-apart relationship to the cross bar;

a locking plate axially movable along the stationary member and having a plurality of slots extending outwardly from an inner periphery surrounding an opening therethrough through which the stationary member is received;

said protuberances operative to prevent the locking plate from moving axially away from the object when not in registration with the slots; and said protuberances operative to be respectively received through the slots upon registration therewith to enable the locking plate to be moved axially away from the object so as to enable the cross bar to be pivoted for removal from the object opening.

* * * * *